United States Patent [19]

Stroh

[11] Patent Number: 4,898,314

[45] Date of Patent: Feb. 6, 1990

[54] METHOD AND APPARATUS FOR STITCHER WIRE LOADING

[75] Inventor: Richard D. Stroh, Longmont, Colo.

[73] Assignee: International Business Machines Corporation, Armonk, N.Y.

[21] Appl. No.: 260,159

[22] Filed: Oct. 20, 1988

[51] Int. Cl.[4] ..... B42B 4/00

[52] U.S. Cl. ..... 227/3; 227/84; 242/54 R

[58] Field of Search ..... 227/3, 84, 109, 120, 227/136, 137, 139; 242/54 R, 156; 206/303, 331

[56] References Cited

U.S. PATENT DOCUMENTS

| | | | |
|---|---|---|---|
| 1,252,011 | 1/1918 | Maynard | 227/84 |
| 2,417,818 | 3/1947 | Finn | 242/1 |
| 2,628,714 | 2/1953 | Schaefer | 206/59 |
| 2,681,401 | 6/1954 | Anderson | 219/8 |
| 2,748,236 | 5/1956 | Landis et al. | 219/8 |
| 3,283,986 | 11/1966 | McKee | 227/120 |
| 3,612,427 | 10/1971 | Bishop et al. | 242/137.1 |
| 4,053,094 | 10/1977 | Males | 227/93 |
| 4,179,028 | 12/1979 | Stemme et al. | 206/316 |
| 4,318,555 | 3/1982 | Adamski et al. | 227/84 X |
| 4,356,947 | 11/1982 | Marshall et al. | 227/5 |
| 4,358,040 | 11/1982 | Stokes | 227/5 |
| 4,531,682 | 7/1985 | Schroder et al. | 242/54 |
| 4,546,910 | 10/1985 | Logtens | 227/155 |
| 4,600,135 | 7/1986 | Mukoyama | 227/120 |

*Primary Examiner*—Frank T. Yost
*Assistant Examiner*—James L. Wolfe
*Attorney, Agent, or Firm*—Charles E. Rohrer; Francis A. Sirr

[57] ABSTRACT

A replaceable, closed, container, cartridge or supply-item cassette holds a roll of stitcher wire from which U-shaped wire staples are to be formed by operation of a stitcher. The wire's end is led from the cassette to the stitcher by way of a flexible tube that terminates in a coupler/handle member. The coupler/handle member includes a releasable wire clamp that is operable to hold the wire's end. The coupler/handle member is constructed and arranged to protect the operator's hands from contact with the wire's sharp, needle-like end. When the coupler/handle member is locked or coupled to the stitcher, the stitcher's wire feed rollers automatically move to a nip-closed position, to entrap the end of the wire, and the wire is automatically released from the wire clamp. The stitcher's wire feed rollers are driven by a stepping motor. The cassette includes a brake that is operable to control the orderly feeding or wire by the stepping motor.

23 Claims, 7 Drawing Sheets

METHOD AND APPARATUS FOR STITCHER WIRE LOADING

DESCRIPTION

1. Field of the Invention

This invention relates to the field of wire stitchers, and more particularly to a method and an apparatus for resupplying a roll of wire to the stitcher when operation of the stitcher causes the wire supply to become exhausted.

2. Background of the Invention

This invention relates to stitchers, i.e. fastening devices that operate to cut a length of wire from the end of a roll or supply of wire, thereafter forming the cut length of wire into a U-shaped staple, and then driving the staple through material, such as a stack of paper sheets that is to be stapled together, and then clinching the legs of the staple.

An exemplary use for such a stitcher is in reproduction devices, such as copiers and printers, where multisheet sets of documents are reproduced, the sets thereafter being individually stapled together.

Details of the construction and arrangement of stitchers per se are not critical to this invention. These devices are relatively complex, and can take a number of detailed forms. A device with which the method and apparatus of the present invention finds utility, without limitation thereto, is described in U.S. Pat. No. 1,252,011, incorporated herein by reference. In accordance with this patent, the stitcher of the present invention includes a wire cutting means, a staple forming means, a staple driving means, and a staple clinching means. While these features are necessary to certain aspects of the invention, for purposes of simplicity they are not shown herein. Rather, reference can be had to aforementioned U.S. Pat. No. 1,252,011.

In the stitcher of U.S. Pat. No. 1,252,011, a vertically reciprocating bender bar operates to bend a short length of wire into a U-shaped staple. A vertically reciprocating driver bar then drives the staple down through one side of the material to be stapled. A clincher mechanism then bends the staple legs down onto other side of the material. During a single down-up reciprocation cycle of the stitcher mechanism, a length of wire is feed from a supply thereof by operation of a reciprocating wire feed mechanism, and a short piece of wire is cut for use in the next stitching cycle. This wire feed mechanism must be manually adjusted in order to fed different lengths of wire, to thus form different size staples.

It is to be understood that in accordance with a feature of the invention, the aforementioned wire feeding mechanism of U.S. Pat. No. 1,252,011 is removed, and in accordance with the invention a separately driven wire feeding means is substituted therefor. Preferably this separately driven wire feeding means is powered by a stepping motor whose step energization determines the length of wire fed to the wire cutter. In this way, the invention separates the power requirements of wire feeding from the power requirements of stitching.

A general feature of the invention is to provide a replaceable wire cassette that houses the stitcher's wire supply.

Supply cassettes are known in the art. Examples are, U.S. Pat. No. 2,628,714, showing a container for a coiled material; U.S. Pat. No. 2,748,236 showing welding apparatus wherein a electrode wire is supplied from a reel to a welding head by way of motor-driven feed rolls and a flexible conduit or hose; U.S. Pat. No. 3,612,427, showing a liquid-tight container for a filament spool, wherein the filament exits the container by way of a nozzle that is formed in the wall of the container; U.S. Pat. No. 4,179,028 showing a roll film cartridge wherein the film end exits the cartridge by way of channel member; and U.S. Pat. No. 4,531,682 showing welding wire held in a cup-shaped circular housing, and having a wire guide tube that guides wire tangentially away from the housing, as the wire is fed by an internal wire feeding means.

Another general feature of the invention is that the wire cassette of the invention guides the stitcher wire to an external wire feeding means.

Supply cassettes of this general type are known in the art. Examples are, U.S. Pat. No. 2,417,818 showing an unwinder mechanism for a spool of wire wherein pivotally mounted, flexible, guide means guides the wire to a pair of feed rollers; U.S. Pat. No. 2,681,401 showing an arrangement for feeding reel-supported filler wire to a welding zone; and U.S. Pat. No. 4,053,094 showing a tool for driving headless nails or pins wherein a wire supply spool is held by a replaceable cartridge having a wire exit opening that includes a wire locking pawl.

A feature of the present invention is to provide a replaceable wire cassette method and apparatus having a flexible tube that terminates in a coupling housing that cooperates with a controllable-step electric motor, such as a stepping motor, to feed the length of wire to be cut by the stitcher. In this way, wire feed is not dependent upon the stitcher's bender-bar/driver-bar reciprocation movement, and the size of the staple can be automatically controlled, for example as a function of the thickness of the material to be stapled.

U.S. Pat. Nos. 4,356,947, 4,546,910 and 4,358,040 are of interest in this regard since they describe stitchers wherein the length of wire presented to a cutter is automatically dependent upon the thickness of the set.

While the above mentioned prior art devices have been generally acceptable for their intended purpose, the need has existed in the prior art for a low cost, disposable, wire feed cassette for a stitcher, wherein the cassette is of such simple and yet advanced design that untrained personnel can replace a stitcher's wire supply, wherein the cassette is constructed and arranged so that the human operator is protected from the needle-like wire end, and wherein the action of mounting the cassette onto the stitcher also operates to place a wire feeding mechanism in operative relation to the wire's end.

SUMMARY OF THE INVENTION

In summary, and with reference to the drawing, the present invention provides a replaceable wire supply apparatus in the form of a wire cassette means 10. This wire cassette is provided with a wire guiding, flexible, hollow, tube 20 that guides wire end 22 to the location of a coupler/handle member 14.

In accordance with the invention, the coupler/handle member includes a wire clamping rod 23 that holds the wire end within a nipple member 24. In this way, the wire is held in a manner to cooperate with a wire feeding means, and yet the operator is protected from the sharp wire end.

A separate wire feeding means 11 is provided, having a pair of wire feeding rollers 16,17 that are driven by a stepping motor. In this way the power requirements of wire feeding are separated from the power requirements of stitching.

This wire feeding means includes a latching handle 15 that has a number of functions. First, operation of this handle will move rollers 16,17 between nip-open and nip-closed positions. Secondly, operation of this handle will couple or uncouple the cassette's coupler/handle member 14 to the wire feeding means. Third, operation of this handle will release wire clamping rod 23 when coupler/handle member 14 is coupled to the wire feeding means. Fourth, operation of this handle will enable a sensor 43 to sense the presence of the coupler/handle member on the wire feeding means. An exemplary use of sensor 43 is to initiate operation of stepping motor 40, to advance a length of wire to the stitcher, where the wire awaits being cut on the next stitching cycle.

Features of the invention include a number of spring brakes 26 that operate to control the unwinding of wire spool 27, and the cooperation of the cassette's locating surface 32 with an opening 33 that is formed in a spring clip 25, to thereby facilitate mounting of the cassette at a position that is spaced from the wire feeding means.

With the foregoing summary of the invention in mind, an object of the present invention is to provide a method and apparatus for the replacement of a stitcher's wire supply that does not require trained personnel, and where wire replacement by a casual operator is safe, due to a construction and arrangement that protects the wire from human contact, while at the same time positioning the end of the wire to be fed by the stitcher's wire feed mechanism.

A further object of the invention is to provide a stitcher wire loading means that does not require manual threading of the wire's end into operative relation with the stitcher's wire feed roller or clamping means.

An additional object of the invention is to provide an output device for a document set reproduction device having a document set stitcher that includes a low cost, disposable, wire supply cassette and a flexible wire exit tube through which the wire exits the cassette, the end of the tube including handle/mounting means for clamping the wire end and for positioning the wire's end in cooperating relation with the stitcher's wire feeding means, wherein the stitcher's wire feeding means includes coupling means operable to couple the handle/mounting means to the stitcher, to close the stitcher's feed rollers in a driving relationship to the surface of the wire, and to release the wire clamp.

Another object of the invention is to provide an substantially enclosed, replaceable, wire cassette in which a roll of wire is housed, the wire's end being threaded through a flexible tube that is attached to the cassette, and the tube terminating in a multi-function housing that functions as a wire-holder, a manual-handle, and a stitcher-coupling member. A human operator uses this housing to mechanically couple the tube's end to the wire-feeding portion of a stitcher, without touching the wire. In this position of the tube's end, stitcher wire feed rollers are operable to engage the wire end in feeding relation.

Another object of the invention is to provide a replaceable wire cassette that operates to automatically position the wire's end when a new cassette is installed, and wherein a length of wire is advanced from the cassette to the stitcher, without requiring that the stitcher itself be cycled in order to the load the length of wire into the stitcher.

Another object of the invention is to provide the combination of a stitcher, a replaceable wire-supply cassette and a wire feeding means for feeding wire from the cassette to the stitcher, wherein the functional operation of feeding wire from the cassette is operationally separated from the functional operations of wire cutting, staple forming, staple driving, and staple clinching.

These and other objects and advantages of the invention will be apparent to those of skill in the art upon reference to the following enabling description of preferred embodiments of the invention, wherein reference is made to the drawing.

DETAILED DESCRIPTION OF THE INVENTION

Figure 1:
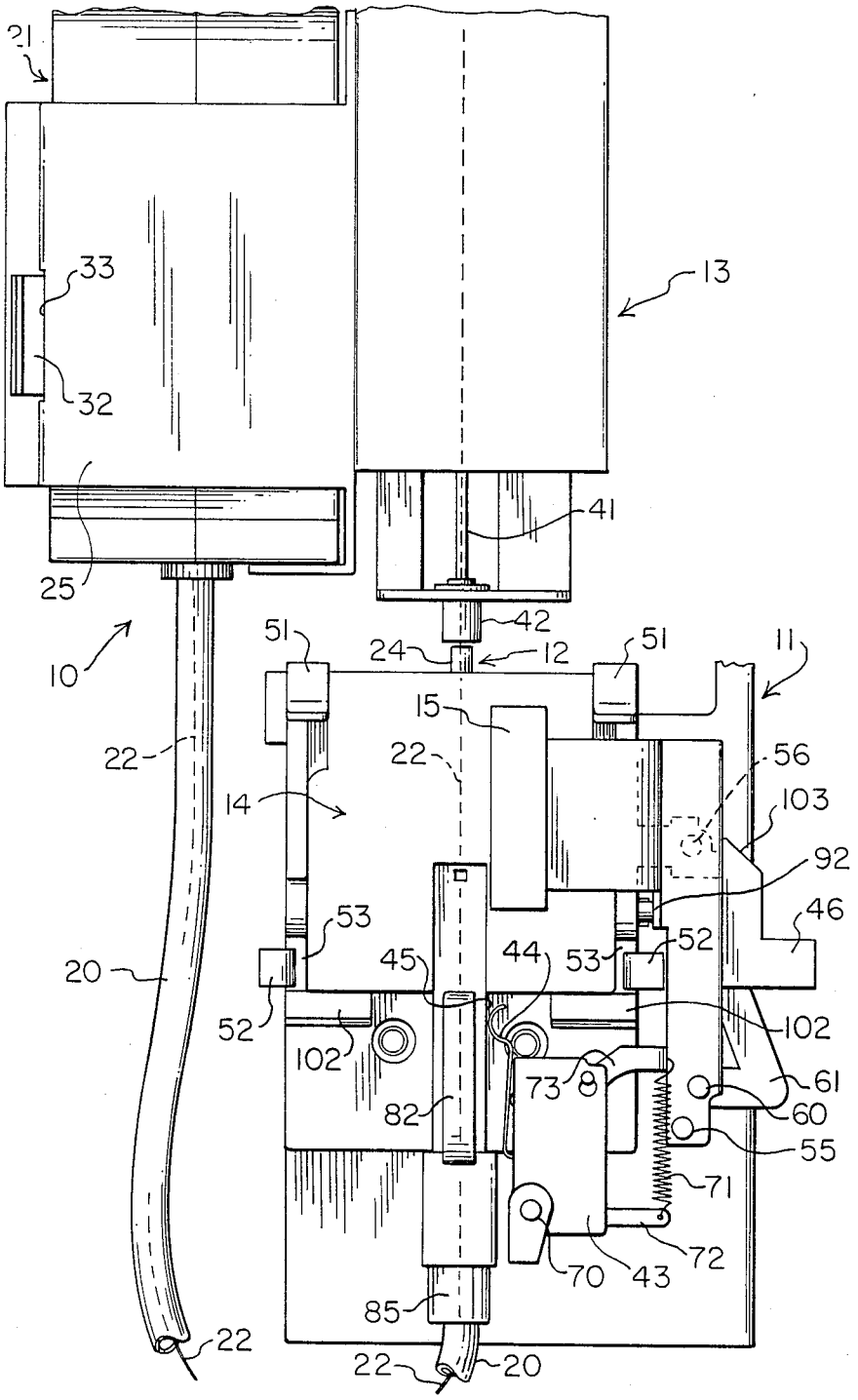
FIG. 1 is a front view of the wire cassette means of the invention coupled to the wire feeding means of the invention, and showing the end of the wire in position to be fed to a vertical wire feed stitcher.

FIG. 1 is a front view of a stitcher 13, a wire cassette means 10 and a wire feeding means 11 that incorporate the invention. For purposes of illustration, an upward, vertical wire feed arrangement is shown. However, the present invention is not to be limited thereto. In addition, stitcher 13 is preferably of the type shown in aforementioned U.S. Pat. No. 1,252,011. However, the present invention is not to be limited thereto, since the invention will function equally well with a horizontal wire feed stitcher.

In accordance with a feature of the invention, the reciprocating wire feeding means of stitcher 13 (as is described in U.S. Pat. No. 1,252,011) has been removed, and this function is performed by wire feeding means 11 of the present invention.

It is preferred, in accordance with one aspect of the invention, that the electric motor (shown in U.S. Pat. No. 1,252,011) that drives stitcher 13 and the electric motor 40 (shown in FIG. 2) that drives wire feeding means 11 be separate sources of mechanical power.

In accordance with another feature of the invention, motor 40 is a stepping motor, thus facilitating the feeding of variable lengths of wire to the stitcher, in accordance with the motor's step length. Stitching cycles of stitcher 13 are counter, using logic means not shown. Prior to wire cassette 21 becoming totally empty of wire, a display is energized by the counter, to indicate a "stitcher wire low" condition to the operator. At this time, a cut length of wire resides in the stitcher, awaiting the next stitching cycle. When the near-empty cassette is replaced by the operator, a sensor 43 senses that a full wire cassette has been provided, and in response to a signal from this sensor, motor 40 is controlled to move a length of wire into the stitcher, without requiring that the stitcher itself cycle. On the next stitching cycle, the cut length of wire resident in the stitcher is formed into a staple, and the wire end from the full cassette is cut to staple length, for use in the next stitcher cycle. In a preferred embodiment, motor 40 is controlled by microcode.

Stitcher 13 includes a metal tube 41 having an open terminating end 42 that receives wire 22 from wire feeding means 11. Thus, it is preferred that wire feeding means 11 be mounted closely adjacent stitcher 13.

FIG. 1 shows the cassette's coupler/handle member 14 (best seen in FIGS. 10–12) mounted on and coupled to the wire feeding means. When wire is initially resupplied to the stitcher, the wire end is contained within nipple 24 that is formed as a portion of the coupler/handle member. In accordance with a feature of the invention, this construction and arrangement protects the operator's hands from the sharp wire end as wire is being resupplied to the stitcher.

Figure 13:
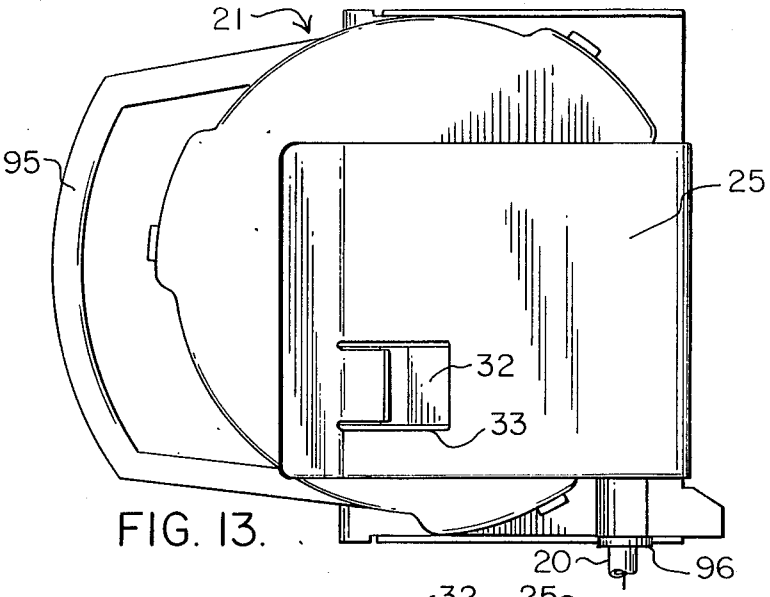
FIG. 13 shows the wire cassette of FIG. 1 mounted in a spring-like clip holder.
Figure 14:
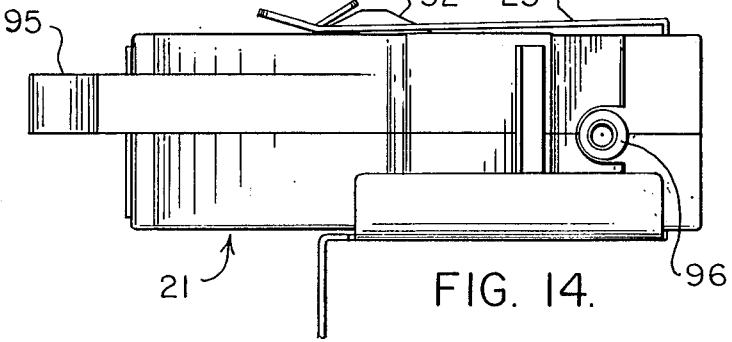
FIG. 14 is a right side view of the wire cassette of FIG. 13.
Figure 15:
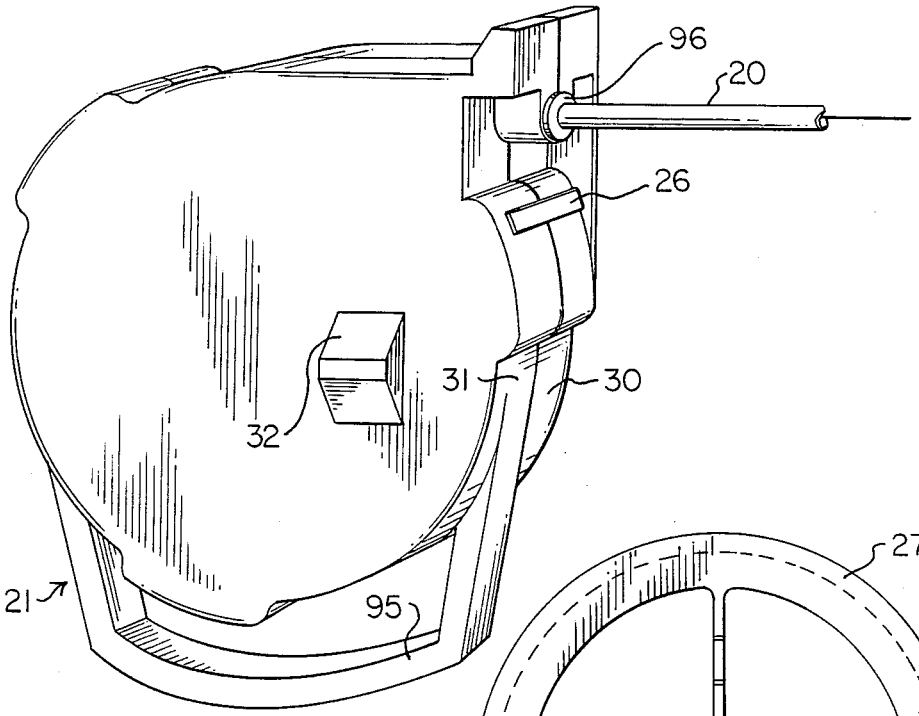
FIG. 15 is a perspective view of the wire cassette of FIG. 13, where the cassette has been removed from the cassette holder shown in FIG. 13, and showing the raised locating surface thereof that cooperates with a locating hole that is formed in the cassette holder.

FIG. 1 also shows wire cassette 21 mounted within a spring clip 25 that is mounted closely adjacent stitcher 13. However, since the wire 22 within the cassette is guided to wire feeding means by way of a flexible, hollow, plastic tube 20, clip 25 can be mounted in any convenient place. A preferred manner of mounting the cassette within clip 25 is to provide a protruding boss or locating surface 32 on the cassette, and a mating hole or opening 33 in the spring clip (see FIGS. 13 and 14).

Figure 3:
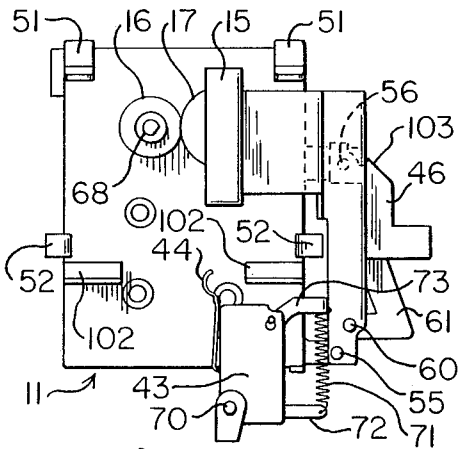
FIG. 3 is a front view of the wire feeding means of FIG. 1, wherein the latching handle is in a latched position, but the coupler/handle is not coupled to the wire feeding means as it is in FIG. 1, thus showing the wire feeding rollers in a closed-nip position.
Figure 4:
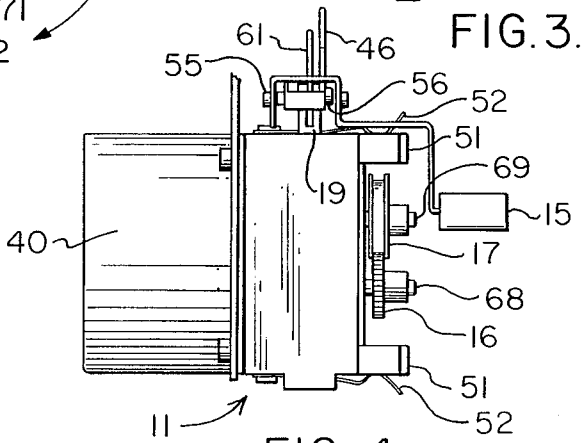
FIG. 4 is a top view of the wire feeding means of FIG. 3.

In FIG. 1 a latching handle 15 (that is portion of wire feeding means 11) is shown in the handle's latched position. In this position of latching handle 15, an offset portion of the metal handle overlies the box-like housing of coupler/handle 14. In this way, coupler/handle 14 is latched to the wire feeding means. In addition, and as will be apparent, this position of latching handle 15 causes the wire clamping means of coupler/handle 14 (i.e. spring biased rod 23 of FIGS. 10–12) to be moved against its spring bias, to thereby release the end of wire 22. A third function performed by latching handle 15 in the FIG. 1 position is to move wire feeding rollers 16,17 to their nip-closed position (as is shown in FIGS. 3 and 4). Another function of latching handle 15 in the FIG. 1 position is to move sensing switch 43 from the inoperative position of FIG. 6 to the operative position shown in FIGS. 1,3. In the operative position, switch actuator 44 is operative to engage the wall portion 45 of coupler/handle 14. Switch 43 then electrically indicates to a control means (not shown) that coupler/handle 14 is properly located on wire feeding means 11.

Also shown in FIG. 1 is a manually operable, pivoted, locking link 46 that locks latching handle 15 in its latched position. As will be apparent, locking link 46 must be manually depressed (i.e. rotated CW from the position shown in FIG. 1) in order to free latching handle 15 so that it can subsequently be manually rotated CW to its unlatched position.

In the unlatched position of latching handle 15, coupler/handle 14 can be manually removed from wire feeding means 11, wire cassette 21 can be removed from spring clip 25, and the supply of wire can be replenished by replacing cassette 21 with a cassette that contains a full spool of wire.

Wire feeding means 11 will now be described with particular reference to FIGS. 2–9, 20 and 21.

Figure 2:
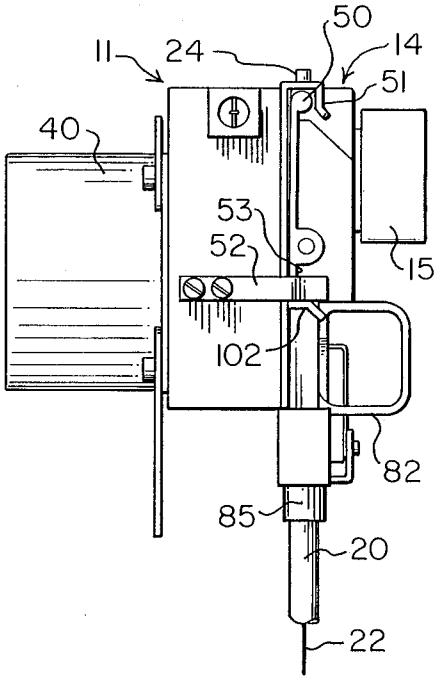
FIG. 2 is a left side view of the wire feeding means and the coupler/handle end of the wire cassette means of FIG. 1.
Figure 10:
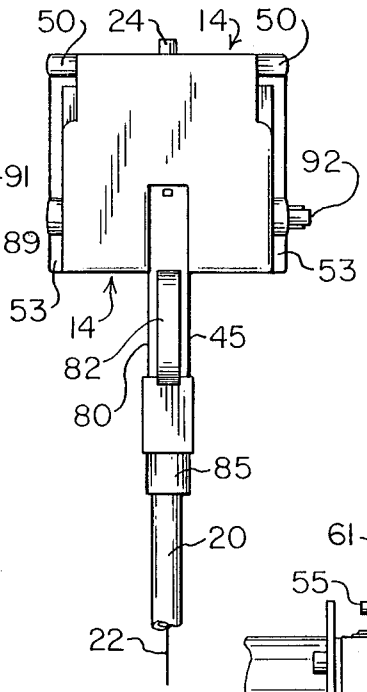
FIG. 10 is a front view of the coupler/handle and a portion of the flexible wire guiding tube that connects the coupler/handle to the wire cassette.
Figure 12:
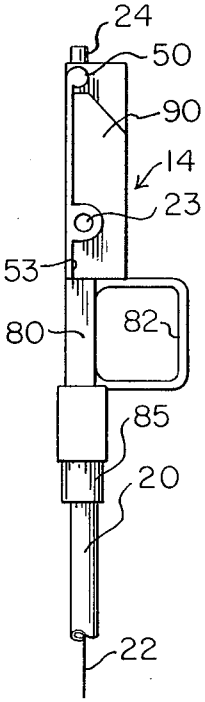
FIG. 12 is a left side view of the coupler/handle of FIG. 10.

FIG. 2 shows coupler/handle 14 latched to wire feeding means 11 by operation of latching handle 15, as above described. From this figure, it can be seen that plastic coupler/handle 14 includes a pair of cylindrical shaped locating bosses 50 that are molded into the coupler/handle (bosses 50 are best seen in FIGS. 10 and 12).

The manual procedure by which the operator places coupler/handle 14 on the wire feeding means involves the step of first inserting bosses 50 upwardly, under metal retaining clips 51, while the coupler/handle is held slightly tilted from the vertical. After bosses 50 have been located under clips 51, coupler/handle 14 is manually pushed down, or rotated CW, to the FIG. 2, generally vertical, position. This step causes a pair of metal guide clips 52 to be deformed outwardly, so as to seat in overlapping relation on the edge surfaces 53 of the coupler/handle (surfaces 53 are best seen in FIGS. 1 and 10). The housing of wire feeding means 11 includes a pair of shelf elements 102 upon which coupler/handle 14 now rests. It should be remembered that at this time latching handle 15 is in the unlatched position shown in FIG. 6, and not in the latched position shown in FIG. 1.

Figure 6:
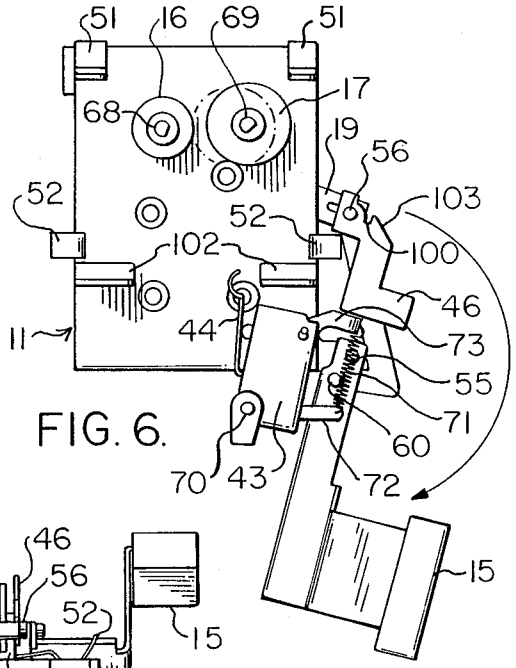
FIG. 6 is a front view of the wire feeding means of FIG. 3, showing the latching handle rotated to its unlatched position, and showing the wire feeding rollers in an open-nip position.
Figure 7:
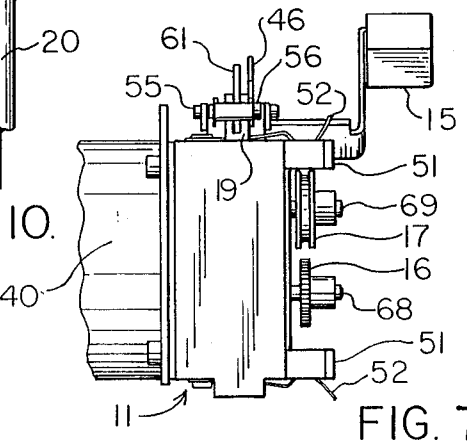
FIG. 7 is a top view of the wire feeding means of FIG. 6.

FIGS. 6 and 7 show wire feeding means 11 as it appears prior to coupler/handle 14 being positioned thereon by way of the manual procedure above described. In this condition of the wire feeding means latching handle 15 and locking link 46 are both in their extreme CW positions.

Figure 8:
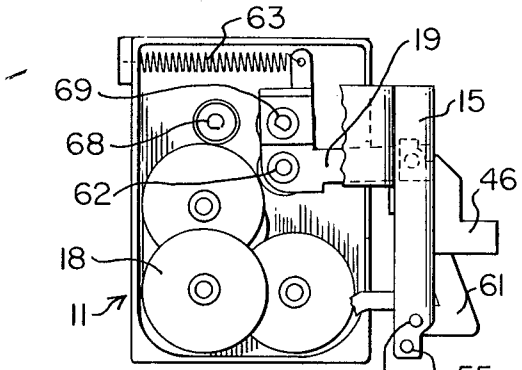
FIG. 8 is a cutaway view of the wire feeding means of FIG. 3, wherein the front plate and the wire feeding rollers have been removed, to thereby expose the drive gears and the spring-biased L-shaped link that operates to move the wire feed rollers between the closed-nip and the open-nip positions.
Figure 9:
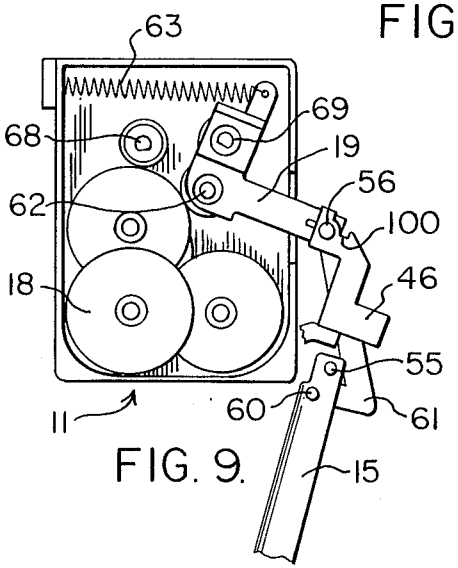
FIG. 9 is a similar cutaway view of the wire feeding means of FIG. 6, showing the L-shaped link rotated CW about its pivot point, by movement of the latching handle to its unlatched position, to thereby move the wire feeding rollers to the open-nip position of FIG. 6.

With specific reference to FIGS. 8 and 9, latching handle 15 is pivoted on a fixed pivot shaft 55 that is formed as a portion of the metal housing of wire feeding means 11. Latching handle 15 carries a pivot shaft 60 on which a metal link 61 is pivoted. Link 61 extends between shaft 60 and a pivot shaft 56 that is carried by L-shaped link 19. Locking link 46 is also pivoted on shaft 56. L-shaped link 19 is in turn pivoted to the housing of wire feeding means 11 by way of a fixed-position pivot 62. L-shaped link 19 is biased CCW about pivot 62 by operation of coil or extension spring 63.

When latching handle 15 is in the unlatched position of FIG. 9, handle 15 is mechanically stable, due to the over center position of shaft 60 relative pivot 55. When latching handle 15 is in the latched position of FIG. 8, the handle is locked in this position by operation of locking link 46.

Locking link 46 is pivoted on pivot shaft 56, which shaft is mounted to the L-shaped link 19. L-shaped link 19 controls the nip-open/nip-closed condition of the wire feeding nip of rollers 16,17 (see link 19 in FIGS. 8,9). Locking link 46 is spring biased CCW about pivot shaft 56, by operation of a torsion spring (not shown) that encircles this pivot shaft.

Figure 20:
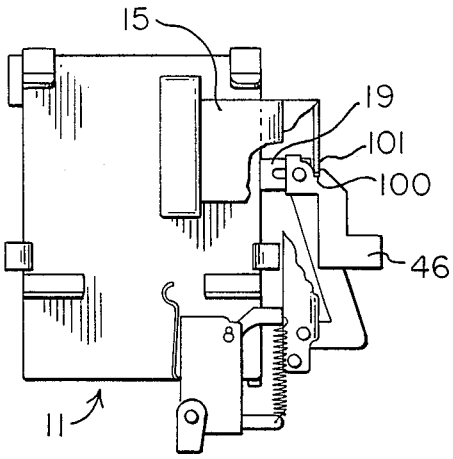
FIGS. 20 and 21 are front and right side views, respectively, of the wire feedings means, these figures showing how the latching handle is locked in place by operation of a locking link.
Figure 21:
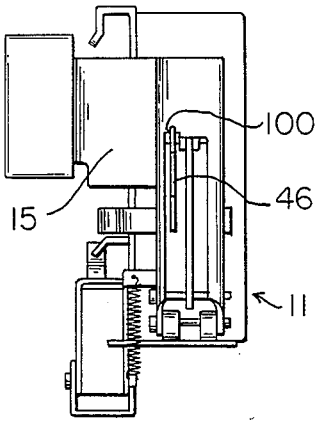

As can be best seen in FIGS. 20 and 21, during the process of rotating latching handle 15 CCW, to the position shown in FIGS. 1, 3 , 8 and 20, locking link 46 is first cammed CW by engagement of its surface 103 with the wall portion 101 of handle 15. Later, handle 15 moves far enough CCW for link 46 to rotate CCW, under the force of its spring bias, enabling the handle's wall portion 101 to drop into notch 100 that is formed in locking link 46. In this position, notch 100 receives and traps the wall portion 101 of handle 15. In this manner, handle 15 is locked in the FIGS. 1, 3, 8, 20 position by operation of link 46. In order to release handle 15, prior to removal of coupler/handle 14 for example, link 46 must be manually rotated CW, against the force of its bias spring, to thereby free latching handle 15 for manual CW rotation to the position shown in FIGS. 6 and 9.

FIGS. 8 and 9 show the drive shafts 68 and 69 of wire feeding rollers 16 and 17, respectively. Shaft 68 is a fixed-position shaft that is carried by the housing of wire feeding means 11. However, shaft 69 is movable in that it is carried by L-shaped link 19. This construction and arrangement is such that shafts 68 and 69 remain engaged with drive gears 18 in all positions of L-shaped link 19. Rollers 16 and 17 are both driven rollers, and they are driven in counter rotating directions.

In its preferred form, and with reference to FIGS. 4 and 7, wire feeding roller 16 is thinner than roller 17, and roller 17 is formed with a U-shaped peripheral surface, such that roller 16 fits within the U-shaped edge of roller 17 when the wire feeding nip is closed, as is best seen in FIG. 4. Rollers 16 and 17 are preferably metal rollers, roller 16 having a knurled wire-driving edge surface, and the U-shaped edge of roller 17 being generally smooth.

Sensing switch 43 is pivotally mounted to the housing of wire feeding means 11 by way of a pivot shaft 70. A coil spring 71 extends between a housing arm 72 and an arm 73 that is a portion of switch 43. Arm 73 includes an offset portion that is located to be engaged by latching handle 15. In this way, switch 43 is spring biased to the inoperative position of FIG. 6, but the switch is rotated CCW about shaft 70 by engagement between arm 73 and latching handle 15, as the latching handle is moved to the latched position shown in FIGS. 1 and 3.

Figure 5:
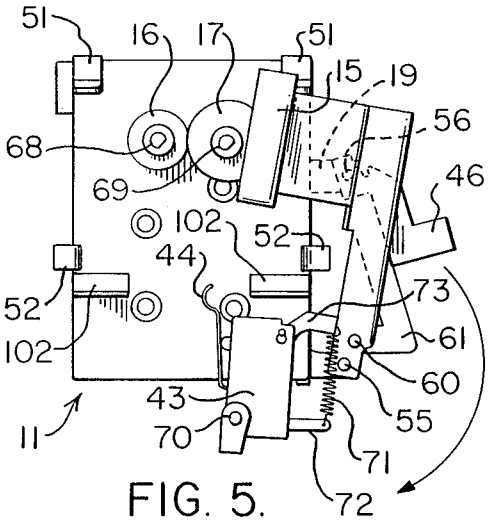
FIG. 5 is a front view of the wire feeding means of FIG 3, but showing the latching handle rotated partially CW toward its unlatched position.

As mentioned, coupler/handle 14 is manually mounted on wire feeding means 11 when the wire feeding nip of rollers 16,17 is open. This is the nip position shown in FIGS. 6 and 7. After coupler/handle 14 is mounted on the wire feeding means, latching handle 15 is manually moved from the position shown in FIGS. 6 and 7 to the position shown in FIGS. 3 and 4. Note that FIG. 5 shows the latching handle in an intermediate position.

In so moving coupler/handle 14, the operator (1) accurately locates wire end 22 adjacent the peripheral drive surface of wire feeding roller 68, thereby placing wire end 22 in the drive nip that will be formed between rollers 16 and 17, (2) closes wire feeding roller 17 onto roller 16, thus trapping wire end 22 in the drive nip, (3) latches coupler/handle 14 to wire feeding means 11, (4) causes latching handle 15 to be locked in this position by operation of locking link 46, and (5) causes switch 43 to move to a position such that an electrical signal is given to a control means, indicating that coupler/handle 14 is properly in position on the wire feeding means.

The foregoing description of a preferred embodiment of wire feeding means 11 is not to be taken as a limitation on the present invention. Those skilled in the art will readily visualize other constructions and arrangements that are within the scope to the invention in that they provide equivalent features to those that are above described.

Figure 11:
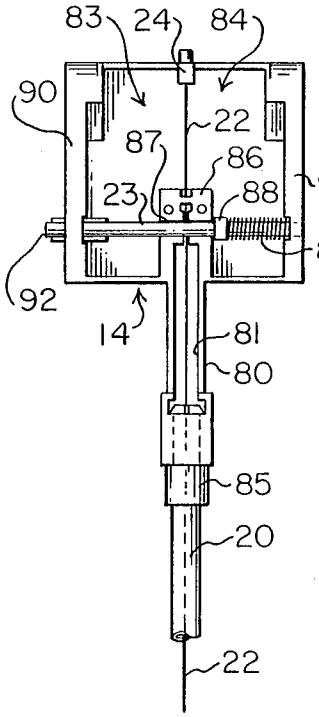
FIG. 11 is a rear view of the coupler/handle of FIG. 10, showing the generally open rear side of the coupler/handle, showing the wire's end clamped by a releasable clamping rod, and showing the wire end supported within a protective nipple member.

Coupler/handle member 14 will now be additionally described with particular reference to FIGS. 10–12.

As mentioned, coupler/handle member 14 is preferably a plastic molded part. While the invention is not to be limited thereto, member 14 is molded in the shape of a box having one open side, this being the side that is shown in FIG. 11, i.e. the side that faces wire feeding means 11. This side of member 14 defines two open cavities 83 and 84 that receive rollers 17 and 16, respectively, when member 14 is mounted on wire feeding means 11.

The bottom wall of box-like member 14 includes an extending channel portion 80, having an open wall portion 81 through which wire 22 can be seen, and having a manual handle portion 82 that is best seen in the side view of FIG. 12. The end of channel portion 80 rotatively mounts a plastic nipple 85 to which flexible plastic tubing 20 is firmly attached.

The interior of member 14 includes a wire-guiding/-rod-guiding structure 86 through which wire 22 passes on its way to nipple 24. Guide 86 also includes a open channel 87 that extends perpendicular to wire 22, and through which the wire clamping rod 23 slideably passes. The two ends of rod 23 are slideably mounted in the two side walls 90 and 91 of member 14. Rod 23 includes a shoulder portion 88 against which a coil spring 89 pushes, to thereby cause the rod to assume the position shown in these figures.

The underside of rod 23 includes a tapered wire-locking groove whose narrow bottom surface is to the right as seen in FIG. 11. When rod 23 is spring-biased to the left, as shown in FIG. 11, wire 22 is pushed to the left by operation of the bottom surface of this groove. In this manner, the wire is frictionally locked in this position by virtue of frictional engagement between the wire and the bottom of the groove in rod 23, and by virtue of frictional engagement of the wire with the portion of guide 86 through which the wire runs. The upper end of wire 22 is at this time concealed within nipple 24, where it is protected from contact with the hands of the operator.

A feature of the invention provides that when member 14 is mounted to wire feeding means 11, and when latching handle 15 has been moved to its latched position, i.e. the position shown in FIG. 1, the end 92 of rod 23 (see FIG. 11) is engaged by handle 15 and is pushed to the right, against the force of spring 89, thus freeing wire 22 for feeding by rollers 16,17.

While a preferred embodiment of coupler/handle member 14 has been described, the invention is not to be limited thereto. Those skilled in the art will readily visualize other constructions and arrangements that will prevent contact with the end of wire 22, and will provide releasably locking of the wire's end, in accordance with the scope of the invention.

Cassette 21 will now be additionally described with particular reference to FIGS. 15–19.

in preferred embodiments of the invention, cassette 21 is a plastic molded part having two similarly shaped shells or halves 30 and 31. Cassette shell 31 includes a manual handle 95 that is used to insert/remove the cassette from its mounting clip 25.

Wire guiding tube 20 is firmly attached to a nipple 96 (see FIGS. 18 and 19) that is rotatively mounted and imprisoned between shells 30,31 when the two shells are clamped together. The means for clamping the shells together comprises three or more deformable latch members 28 on shell 31 that receive and imprison similarly located latch members 29 on shell 30.

Figure 17:
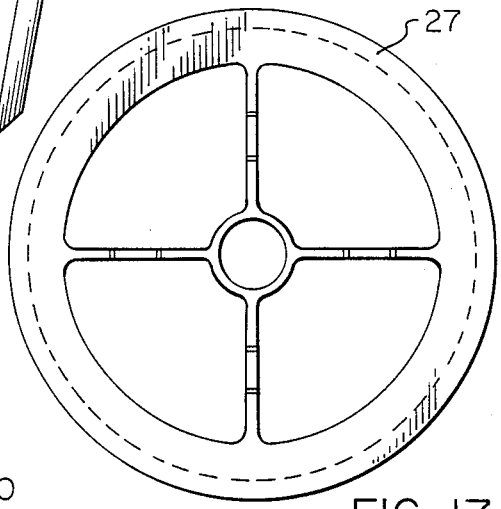
FIG. 17 is a top view of the roll of wire that is confined and protected within the wire cassette.

Cassette half 30 includes a centrally located post or shaft 97 that rotatively supports the plastic wire spool or reel 27 shown in FIG. 17. In an exemplary embodiment, spool 27 has a diameter of about 12.5 cm, and an axial length of about 4.5 cm. In this exemplary embodiment, the stitcher wire 22 held by spool 27 was about 25 gauge, had a circular cast of about 400 mm, and had a tensile strength of about 900 Newtons per square mm. About 2.2 pounds force was required from rollers 16,17 in order to pull wire from the cassette.

Figure 16:
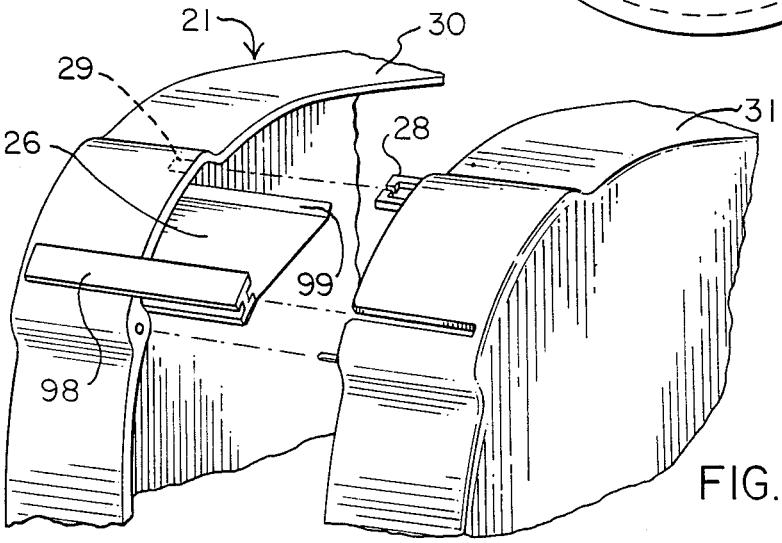
FIG. 16 is a partial exploded view of the wire cassette, showing one of the three spring brakes that function to both brake the wire reel and confine unwinding of the roll of wire, and showing the latch means that operates to fasten the two halves of the cassette together.
Figure 19:
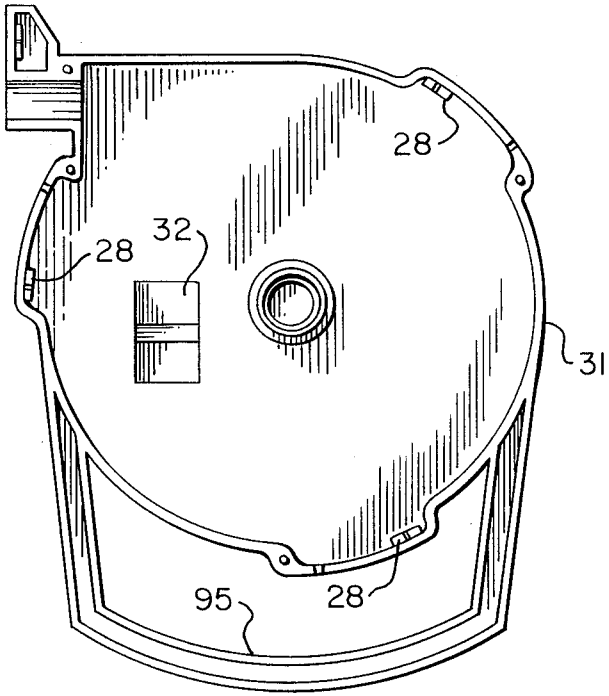
FIG. 19 is a planar view of the top half of the wire cassette.
Figure 18:
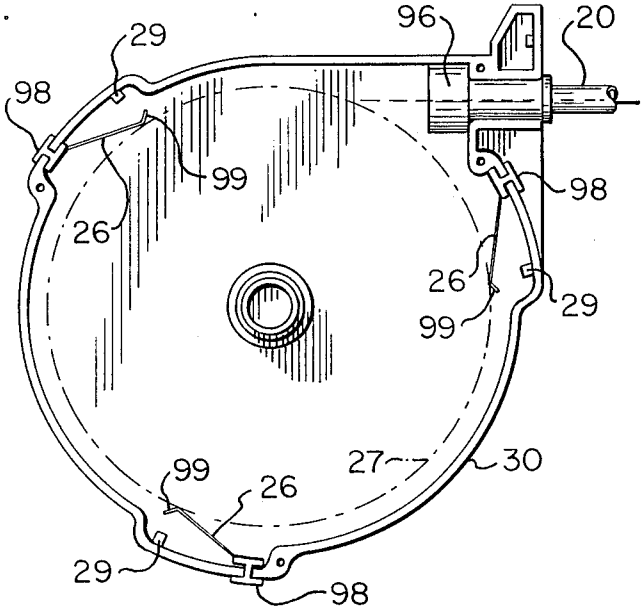
FIG. 18 is a planar view of the bottom half of the wire cassette, showing the three spring brakes, and showing the roll of wire of FIG. 17 in dotted outline.

A feature of the invention comprises a brake means that controls the orderly unwinding of wire 22 from spool 27. The preferred embodiment provides three metal spring brakes 26, each brake comprising a metal spring blade that is molded into an H-shaped plastic slide member 98 that is slidingly received by slots that are formed in cassette halves 30,31, as is best seen in FIGS. 16 and 18. As can be seen from the drawing, the free ends of these spring blades terminate in an offset bent portion 99, and the brake members are mounted with approximate 120-degree separation around the circumference of the cassette, to thereby define a circle having a diameter that is somewhat smaller than the diameter of reel 27. Since the free state of these spring blades define a relatively small diameter circle, after reel 27 has been placed within cassette 21, the spring blades press against the reel flange, and operate as a brake, to limit inertial unwinding of wire 22. In addition, the portion 99 of the spring blades confine the unwinding of the wire on spool 27 to a diameter that is defined by the outer edges of the reel flanges upon which brake portions 99 slide. This feature also contributes to the orderly unwinding of the wire from the reel.

In an alternative embodiment of the invention, brake means 26 comprised deformable elastomeric foam members that operated to both brake the reel flanges and to confine the diameter of unwinding of the wire held by the reel.

From the foregoing description, it can be seen that the present invention provides new and an unusual means whereby wire may be resupplied to a stitcher, and to its wire feeding means, in a convenient and safe manner, and by unskilled individuals. In addition, the invention provides new and unusual wire feeding means that cooperates with the wire resupply means in a new and unusual manner, and also enables the feeding of wire to be operationally separated from the stitching operation.

The foregoing description of preferred constructions and arrangements by which the various features of the invention are provided is for the purpose of enabling those skilled in the art to duplicate the scope and spirit of the invention, and is not to be taken as a limitation on the invention.

What is claimed is:

1. A wire dispensing supply item having a reel of wire that includes a wire end, said supply item being for use with a stitcher having wire cutting means, wire feeding means for feeding said wire end to said wire cutting means, and manually operable coupling means for releasably receiving a handle/mounting member of said supply item, said handle/mounting member, when coupled to said coupling means, being operable to support said wire end in operative relation to said wire feeding means, said supply item comprising;

a reel of wire rotatably mounted in a substantially closed housing, a flexible tube having one end connected to said housing, said tube operating to guide said wire end away from said reel of wire, a handle/mounting member connected to said tube at the other end thereof, said handle/mounting member being constructed and arranged to releasably cooperate with the manually operable coupling means of said stitcher, and releasably wire holding means contained within said handle/mounting member for releasably holding said wire end, the manually operable coupling means of said stitcher being operable to couple said handle/mounting member with said wire end in operating relation to said wire feeding means, and in so doing, to release said releasable wire holding means.

2. The supply item of claim 1 wherein said handle/mounting member substantially encloses said wire end, to thereby minimize contact between said wire end and a human operator as the supply of wire is replenished.

3. The supply item of claim 1 wherein the wire feeding means comprises a pair of wire gripping rollers that define a wire feeding nip, said wire feeding rollers being relatively movably mounted to selectively assume a nip-open position or a nip-closed position, and wherein said manually operable coupling means includes means operable to relatively move said wire gripping rollers from said nip-closed position to said nip-open position when said handle/mounting member is moved to a position enabling removal from the stitcher, and is operable to relatively move said wire gripping rollers from said nip-open position to said nip-closed position when said handle/mounting member is coupled to the wire feeding means.

4. The supply item of claim 3 wherein said substantially closed housing includes a reel brake cooperating with said reel of wire, and operable to control the unwinding of the wire by the wire feeding means.

5. The supply item of claim 4 wherein said substantially closed housing includes means for mounting said substantially closed housing in spaced relation to said handle/mounting member and the stitcher.

6. Supply-item apparatus for replenishing the supply of wire to a stitcher having manually operable coupling means adapted to releasably couple a portion of said supply-item apparatus to said stitcher, comprising;

a replaceable cassette containing a roll of stitcher wire from which U-shaped wire staples are to be formed by operation of a stitcher, a handle/mounting member for cooperating with the coupling means of said stitcher, and including a releasable wire clamp operable to hold the wire end of said roll of wire, and a flexible hollow tube containing the wire end, and leading said wire end from said cassette to said handle/mounting member, said handle/mounting member being constructed and arranged as a substantially closed housing, so as to protect the operator's hands from contact with the wire end.

7. The apparatus of claim 6 wherein said releasable wire clamp includes operator means extending external of said substantially closed housing, said operator means being adapted to automatically release the wire end when said handle/mounting member is mounted to the manually operable coupling means of the stitcher.

8. The apparatus of claim 7 including brake means operable to control the orderly feeding of wire from said roll.

9. The apparatus of claim 7 in combination with a stitcher having a pair of wire feed rollers having facing peripheral surfaces that define a wire feeding nip, said feed rollers being relatively moveable between a nip-closed position whereat the wire end is trapped in said nip, and a nip-open position whereat the wire end is released from said nip, and locking means operated by said manually operable coupling means and cooperating with said feed roller means and with said handle/mounting member, said locking means being movable from a first position whereat said feed rollers are moved to said nip-open position, said releasable wire clamp is moved to clamp the wire end, and said handle/mounting member is unlocked from the stitcher, to a second position whereat said feed rollers are moved to said nip-closed position, said releasable wire clamp is moved to release the wire end, as said handle/mounting member is locked to the stitcher.

10. The apparatus of claim 9 including brake means operable to control the orderly feeding of wire from said roll.

11. The combination of claim 10 including stepper motor means connected to drive said feed rollers.

12. In combination, a stitcher having wire cutting means, staple forming means, staple driving means, and staple clinching means, first power means for driving said cutting means, said staple forming means, said staple driving means, and said staple clinching means, a replaceable wire-supply cassette having as integral portions thereof, a housing for holding a supply of wire, a mechanical coupler/handle member, and a flexible hollow tube that mechanically interconnects said housing and said coupler/handle member and guides said wire from said housing to said mounting/coupling member, stitcher coupling means for receiving said coupler/handle member, and wire feeding means for feeding wire from said coupler/handle member to said wire cutting means, and second power means, separate from said first power means, for driving said wire feeding means, whereby the functional power operation of feeding wire from the cassette is operationally separated from the functional power operations of wire cutting, staple forming, staple driving, and staple clinching.

13. The combination of claim 12 wherein said coupler/handle member includes releasable means for clamping the wire and for positioning the wire in cooperating relation with said wire feeding means, said wire feeding means includes feed rollers relatively movable between a nip-open and a nip-closed position, and said wire feeding means includes means operable to concomitantly (1) couple said coupler/handle member to said wire feeding means, (2) relatively move said feed rollers to said closed-nip position, and (3) release said wire clamp.

14. The combination of claim 13 wherein said wire feeding means includes sensing means operable to sense the presence or absence of said coupler/handle member in a mounted position on said wire feeding means.

15. The combination of claim 14 wherein said first power means is a first electric motor, and said second power means is a second electric motor.

16. The combination of claim 15 wherein said second electric motor is a stepping motor, the number of energization steps of which determines the length of wire to be fed to said wire cutting means.

17. The combination of claim 16 wherein said wire-supply cassette housing includes wire brake means to control the feeding of wire by said stepping motor.

18. A method for replenishing the supply of wire to a stitcher, comprising the steps of;

providing a replaceable cassette containing a roll of stitcher wire from which U-shaped wire staples are to be formed by operation of a stitcher, providing a handle/mounting member including a releasable wire clamp operable to hold the wire end of said roll of wire, providing a flexible hollow tube containing the wire end, and leading said wire end from said cassette to said handle/mounting member, and constructing and arranging said handle/mounting member as a substantially closed housing, so as to protect the operator's hands from contact with the wire end.

19. The method of claim 18 including the step of providing a releasable wire clamp having operator means extending external of said substantially closed housing, said operator means being adapted to automatically release the wire end when said handle/mounting member is mounted to a stitcher.

20. The method of claim 19 including the step of providing brake means operable to control the orderly feeding of wire from said roll.

21. The method of claim 19 including the step of providing a stitcher having wire feed roller means automatically moveable between a nip-closed position whereat the wire end is trapped in the nip, and a nip-open position whereat the wire end is released from the nip, and having locking means cooperating with said feed roller means and with said handle/mounting member, wherein said locking means is movable from a first position whereat said feed roller means are moved to said nip-open position, said releasable wire clamp is moved to clamp the wire end, and said handle/mounting member is unlocked from the stitcher, to a second position whereat said feed roller means are moved to said nip-closed position, said releasable wire clamp is moved to release the wire end, as said handle/mounting member is locked to the stitcher.

22. The method of claim 21 including the step of providing brake means operable to control the orderly feeding of wire from said roll.

23. The method of claim 22 including the step of providing stepper motor means connected to drive said feed roller means.

* * * * *